United States Patent [19]

Ehrenhalt et al.

[11] Patent Number: 4,868,532

[45] Date of Patent: Sep. 19, 1989

[54] TRANSFORMER WITH A TWO-PIECE PRIMARY WINDING AND HOUSING

[75] Inventors: Dan Ehrenhalt, Buffalo; George R. Giles, Getzville, both of N.Y.

[73] Assignee: LTV Aerospace & Defense Company, Buffalo, N.Y.

[21] Appl. No.: 312,317

[22] Filed: Feb. 16, 1989

Related U.S. Application Data

[63] Continuation of Ser. No. 156,173, Feb. 16, 1988, abandoned.

[51] Int. Cl.[4] ..... H01F 27/30

[52] U.S. Cl. ..... 336/82; 336/223; 336/229

[58] Field of Search ..... 336/82, 173, 174, 175, 336/223, 225, 229

[56] References Cited

U.S. PATENT DOCUMENTS

| | | | |
|---|---|---|---|
| 2,901,713 | 8/1959 | Handmann | 336/82 |
| 4,616,205 | 10/1986 | Praught et al. | 336/82 |

FOREIGN PATENT DOCUMENTS

| | | | |
|---|---|---|---|
| 261059 | 2/1960 | Australia | 336/223 |
| 1080320 | 8/1967 | United Kingdom | 336/82 |

*Primary Examiner*—Thomas J. Kozma

*Attorney, Agent, or Firm*—Brooks & Kushman

[57] ABSTRACT

Described is a transformer having a two-piece primary winding and housing wherein the second piece is mechanically received within the first piece and electrically coupled together.

6 Claims, 2 Drawing Sheets

TRANSFORMER WITH A TWO-PIECE PRIMARY WINDING AND HOUSING

This is a continuation of co-pending application Ser. No. 156,173, now abandoned filed on Feb. 16, 1988.

TECHNICAL FIELD

The present invention relates generally to transformers, and more particularly to a transformer with a two-piece primary winding and housing.

BACKGROUND OF THE INVENTION

Electrical devices which transform electric energy from one or more circuits to one or more other circuits through electromagnetic induction are commonly referred to as transformers. Generally, a transformer consists of two or more windings (primary and secondary, etc.) interlinked by a mutual magnetic field.

The usefulness of a transformer lies in the fact that electrical energy can be transferred from one circuit to another without direct connection, and in the process can be readily changed from one voltage level to another. Transformers are widely used in lowpower, low-current applications where a large power output is required. The power output is determined by the turns ratio between the primary and secondary windings. By properly proportioning the numbers of primary and secondary turns, any desired voltage ratio, or ratio of transformation can be obtained.

A problem encountered in the field of transformers is that there is always some power loss in the resistance of the coils and in the core. As a result, the power taken from the input or source will usually exceed that taken from the secondary coil. Although power losses may be reduced by decreasing the number of turns in the coils, this approach is usually self-defeating since the voltage induced in the coils is proportional to the number of turns in the coils.

One previously known means for reducing power losses and improving the efficiency of transformers is shown in U.S. Pat. No. 1,790,906 to Eckman. In that patent, a transformer is disclosed in which the primary coil is entirely enclosed by an outer housing which also forms the secondary winding of the transformer.

Similarly, U.S. Pat. No. 2,553,665 to McKechnie discloses a transformer having a secondary winding formed from a one piece casting which has at least two complete turns. Like the Eckman transformer, The McKechnie transformer also discloses an outer housing formed from the secondary winding.

Lastly, U.S. Pat. No. 512,603 to Coffin discloses a transformer having a one piece secondary winding.

Each of the above patents discloses a transformer which incorporates a one-piece secondary winding and housing. This design improves efficiency and prevents contamination of the coils by foreign material. However, each design still requires a muliturn primary winding and a large input voltage to produce the desired power output.

It would be highly desirable to design a transformer that is highly power efficient and does not require a large input voltage or a multi-turn primary winding.

SUMMARY OF THE INVENTION

The present invention addresses the power loss mechanisms inherent in conventional transformer designs: the loss of power in the resistance of the coils and in the core.

In accordance with the present invention, there is disclosed herein a transformer for use in a FET modulator which is relatively small, can produce variable pulse widths and requires a low input voltage.

The transformer comprises a two-piece primary winding and housing wherein the second piece is mechanically received within the first piece and electrically coupled together to provide a two-turn electrically conductive path.

BRIEF DESCRIPTION OF THE DRAWINGS

The present invention will be more clearly understood by reference to the following detailed description of the preferred embodiment when read in conjunction with the accompanying drawings in which like reference characters refer to like parts throughout the views and in which.

DETAILED DESCRIPTION OF THE INVENTION

Figure 1:
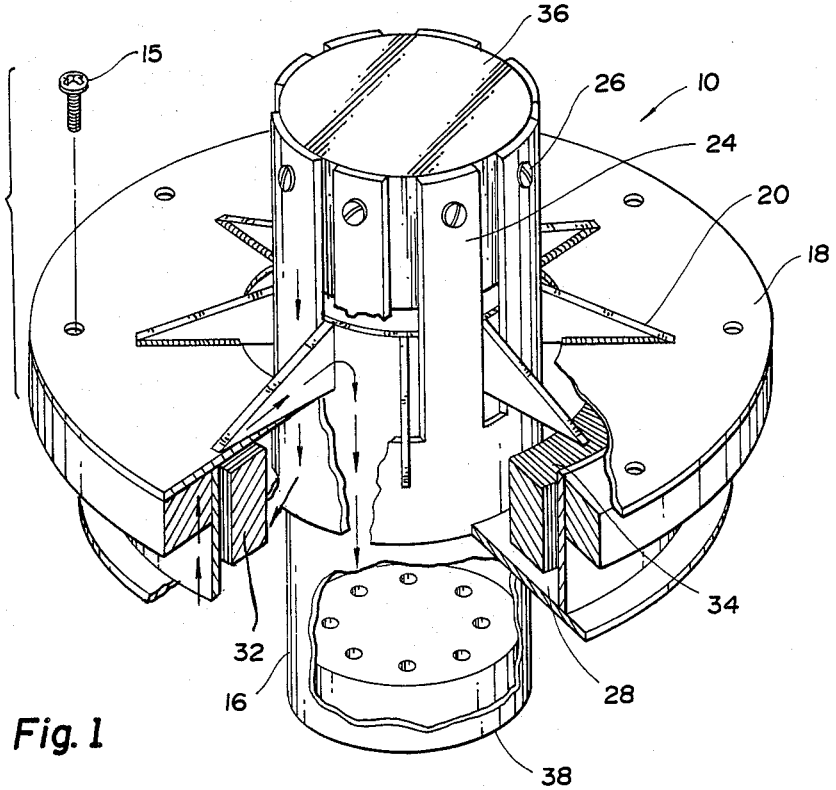
FIG. 1 is a perspective view, partially broken away and in cross section, of a transformer constructed in accordance with the present invention.

The invention will be more clearly understood by referring to FIG. 1 which depicts a transformer for use in a microwave tube modulator generally referred to by reference numeral 10. A microwave tube modulator is a device that can deliver the high voltage pulses that are required for the anode/cathode circuit of a microwave tube. Modulators are used to drive microwave tubes like magnatrons, pulse cavity oscillators, cross field amplifiers and travelling wave tubes. A modulator, microwave tube and a power supply form a pulse microwave transmitter. In operation, the modulator will receive a pulse from a pulse generator, and will produce the proper pulse for the microwave tube.

The transformer disclosed herein is designed to couple with a group of field effect transistors to create the high voltage pulse that is required for a microwave tube. In accordance with the present invention, the transformer 10 is comprised of two pieces 12 and 14 most clearly shown in FIG. 4.

Figure 2:
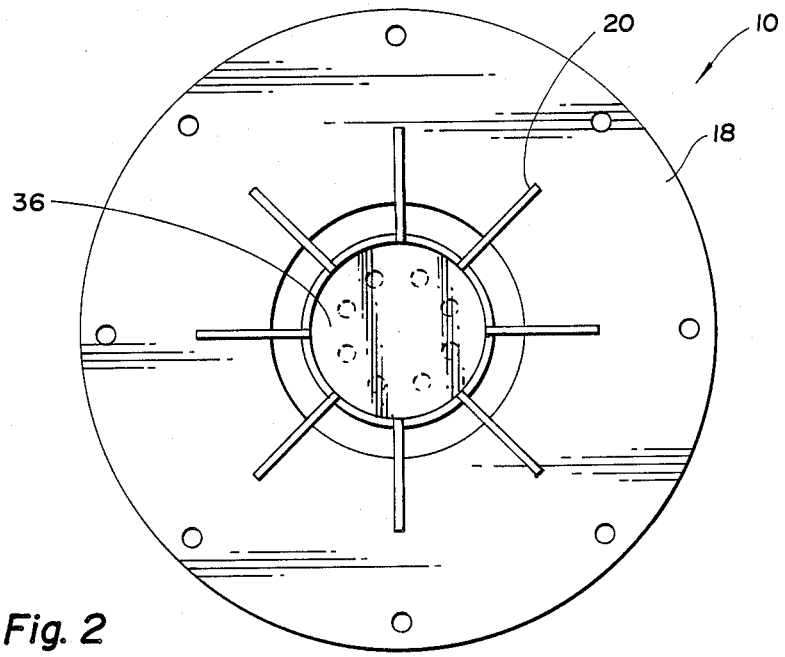
FIG. 2 is a plan view of the transformer.
Figure 4:
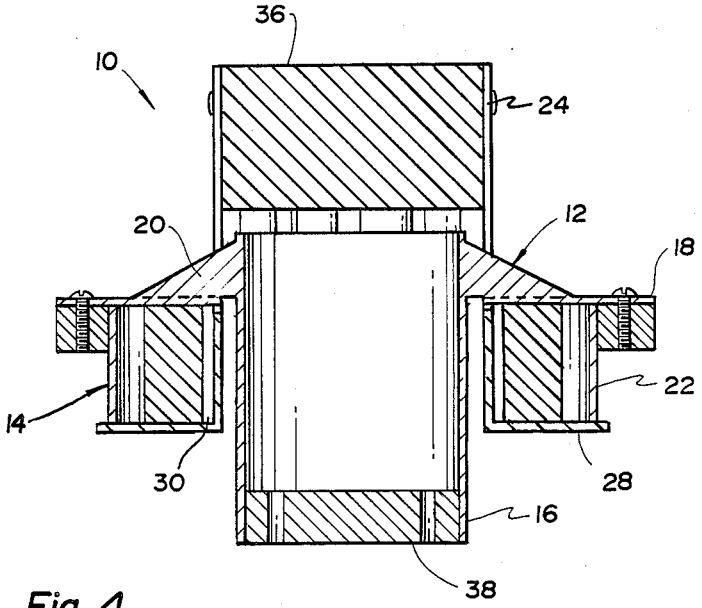
FIG. 4 is a sectional view of the transformer.

Referring to FIG. 4 of the present invention, there is disclosed a first piece 12 having an elongated center section 16 having a top portion 17 and a bottom portion 19 and a cover plate 18 which is fixably attached to the center section by gussets 20 which radially extend from the center section. As more clearly illustrated in FIGS. 1 and 2, the cover plate 18 comprises an annular ring which is fixably attached to the center section 16 by gussets 20 comprising right triangular flanges.

Referring again to FIG. 4, there is disclosed a second piece 14 comprising an annular base ring 22 having a top portion 23 and a bottom portion 25.

Referring back to FIG. 1 of the present invention, there is further disclosed an inner lip 28 affixed to the annular base ring bottom portion 25 of the second transformer piece 14. The inner lip circumferentially extends inwardly from the annular base ring bottom portion 25 and outwardly from the center section 16 of the first transformer piece 12 to define an internal compartment 30 between the annular base ring 22 and the center section 16 of the first transformer piece 12 when coupled with the second transformer piece 14. As more clearly illustrated in FIG. 4, the inner lip 28 provides the structural base of the internal compartment 30 where the transformer core 32 and the secondary windings 34 which are wound thereon are disposed. There are further disclosed flanges 24 which extend radially from inner lip 28 to couple with the first piece of the transformer 12. The flanges 24 are arranged to define a cylindrical channel wherein the first transformer piece 12 will couple. The flanges 24 are fixably attached to the top interface member 36 by fasteners 26.

Figure 3:
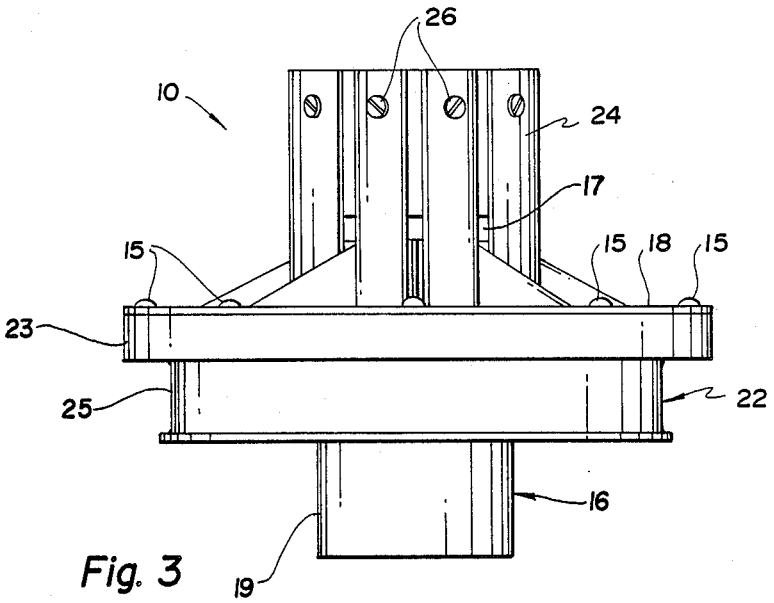
FIG. 3 is a side elevational view of the transformer.

Referring now to FIG. 3 of the present invention, transformer pieces 1 and 2 generally referred to by numerals 12 and 14 in FIG. 4, are coupled together to form the two-piece, two-turn primary winding and housing of the present invention. The cover plate 18 of the first transformer piece 12 is then fixably attached to the top portion 23 of the base ring 22 of the second transformer piece 14 by fasteners 15.

As set forth above, the transformer disclosed is coupled to a group of high power field effect transistors. The FET's are grouped in four quadrants. Each quadrant has all the necessary driver circuits to drive the FET's that are in the primary circuit of the output transformer. The top interface member 36 and the bottom interface member 38 of the transformer 10 are machined to form electrical and mechanical interfaces to the quadrants.

As a preferred embodiment of the present invention, the transformer has a very high turns ratio between the secondary and the primary windings. A high current (2600–3000 amperes) pulse at the primary produces a high voltage pulse at the secondary. The high current pulse is produced by the group of power FET's in parallel. By incorporating a two-piece two-turn primary winding within the transformer, the conductor provides a current path with minimum resistance and minimum inductance so that a 3000 ampere pulse with a fast rise and fall time may be carried easily.

In operation, the current flows from the top interface 36 through the flanges 24 of second transformer piece 14 to the base ring 22 which the flanges 24 radially extend from. Electrical current continues to flow up through the base ring 22 to the cover plate 18 of first transformer piece 12. Thereafter, electrical current flows through the gussets 20 of first transformer piece 12 once again to the center section 16 of the same transformer piece. Finally, electrical current flows down through the center section 16 of first transformer piece 12 to the bottom interface 38.

As can be seen from FIG. 1 of the present invention, electrical current thus passes twice through the center of the core providing a two-turn primary winding.

In operation, the core cavity may be potted or filled with oil. Also, secondary wires may be connected through potted or capped holes in the transformer.

What is claimed is:

1. A transformer comprising:

a first piece having an elongated center section, said center section having a top portion and a bottom portion, and a cover plate axially displaced about said center section and affixed thereto by right triangular gussets radially extending from said center section top portion;

a second piece having an annular base ring, said base ring having a top portion and a bottom portion and an inner lip circumferentially extending inwardly from said base ring bottom portion and affixed thereto and flanges which radially extend upwards from said inner lip to define a plurality of vertical grooves therebetween and a cylindrical channel for mechanically receiving said gussets and said center section, respectively, of said first piece such that said cover plate and said annular base ring are electrically and mechanically coupled to define a primary winding having a two-turn electrically conductive path which forms an internal compartment that house and supports a secondary winding;

a bottom plate affixed to said center section bottom portion; and a top plate affixed to said flanges.

2. A transformer as in claim 1 wherein said center section is cylindrical.

3. A transformer as in claim 1 wherein said top plate and said bottom plate form electrical and mechanical interfaces when used in cooperation with an FET modulator.

4. A transformer as in claim 1 wherein said first and second pieces of the transformer are comprised of copper.

5. A transformer for use in cooperation with an FET modulator, comprising:

a first piece having a cylindrical, elongated center section, said center section having a top portion and a bottom portion, and a cover plate axially displaced about said center section and affixed thereto by right triangular gussets radially extending rom said center section top portion;

a second piece having an annular base, ring, said base ring having a top portion and a bottom portion and an inner lip circumferentially extending inwardly from said base ring bottom portion and affixed thereto, and flanges which radially extend upwards from said inner lip to define a plurality of vertical grooves therebetween and a cylindrical channel for mechanically receiving said gussets and said center section, respectively, of said first piece such that said cover plate and said annular base ring are electrically and mechanically coupled to define a primary winding having a two-turn electrically conductive path which forms an internal compartment that houses and supports a secondary winding;

a bottom plate affixed to said center section bottom portion; and a top plate affixed to said flanges such that said top and bottom plates form electrical and mechanical interfaces when used in cooperation with an FET modulator.

6. A transformer as in claim 5 wherein said first and second pieces of the transformer are comprised of copper.

* * * * *

UNITED STATES PATENT AND TRADEMARK OFFICE

CERTIFICATE OF CORRECTION

PATENT NO. : 4,868,532

DATED : September 19, 1989

INVENTOR(S) : DAN EHRENHALT et al.

It is certified that error appears in the above-identified patent and that said Letters Patent is hereby corrected as shown below:

Column 4, Claim 1, Line 17, "house" should be --houses--;

Column 4, Claim 5, Line 37, "rom" should be --from--;

Column 4, Claim 5, Line 38, After "base" delete --,--.

Signed and Sealed this

Nineteenth Day of March, 1991

*Attest:*

HARRY F. MANBECK, JR.

*Attesting Officer*

*Commissioner of Patents and Trademarks*